United States Patent [19]

Sano et al.

[11] Patent Number: 5,015,497

[45] Date of Patent: May 14, 1991

[54] CATHODE FOR ELECTRON TUBE AND MANUFACTURING METHOD THEREOF

[75] Inventors: Kinjiro Sano; Toyokazu Kamata, both of Nagaokakyo; Keiji Fukuyama, Kamakura; Masato Saito, Kamakura; Keiji Watanabe, Kamakura, all of Japan

[73] Assignee: Mitsubishi Denki Kabushiki Kaisha, Tokyo, Japan

[21] Appl. No.: 377,516

[22] Filed: Jul. 10, 1989

Related U.S. Application Data

[62] Division of Ser. No. 864,566, May 16, 1986, Pat. No. 4,864,187.

[30] Foreign Application Priority Data

May 25, 1985 [JP] Japan ..... 60-112601
May 25, 1985 [JP] Japan ..... 60-112602

[51] Int. Cl.[5] ..... B05D 5/12

[52] U.S. Cl. ..... 427/77; 427/126.2; 427/126.3

[58] Field of Search ..... 427/77, 126.2, 126.3

[56] References Cited

U.S. PATENT DOCUMENTS 4,216,408 8/1980 Verstegen et al. ..... 252/301.6 R
4,441,049 4/1984 Verstegen et al. ..... 252/301.4 R
4,518,890 5/1985 Taguchi et al. ..... 252/521

FOREIGN PATENT DOCUMENTS 0091161 4/1982 European Pat. Off. .
2116356 3/1982 United Kingdom .

*Primary Examiner*—Janyce Bell
*Attorney, Agent, or Firm*—Lowe, Price, Leblanc, Becker & Shur

[57] ABSTRACT

A cathode for an electron tube in accordance with the present invention comprises: a base (2) containing not only nickel as a major element but also a reducing agent; a layer (3) of an electron-emissive substance which is applied to the base (2) and contains not only an alkaline earth metal oxide as a principal component but also a scandium oxide; and a heater for heating the layer (3).

6 Claims, 4 Drawing Sheets

CATHODE FOR ELECTRON TUBE AND MANUFACTURING METHOD THEREOF

This application is a division of application Ser. No. 06/864,566 filed May 16, 1986, now U.S. Pat. No. 4,864,187.

BACKGROUND OF THE INVENTION

1. Field of the Invention

This invention relates to a cathode for an electron tube and more particularly to improvement in electron emission characteristics of the cathode.

2. Description of the Prior Art

It is now still desired to make the electron beam diameter further smaller for improvement of the resolution in a cathode-ray tube for a high resolution display, a projection picture tube for a large screen, or the like. It is also desired to increase the emission current of a cathode in such an electron tube in order to improve brightness of the image particularly in a recent large-scaled tube. Therefore, there is a high demand for a cathode which can be used at a high current density, for example, in a recent high graded cathode-ray tube or an image pickup tube for the TV system.

Referring to FIG. 1, there is illustrated the structure of a cathode in a sectional view. Engaged with a sleeve 1 is a base 2 to which a layer 3 of an electron-emissive substance is applied. The base 2 is made of Ni containing a small amount of a reducing agent such as Si or Mg. A heater 4 for heating the electron-emissive layer 3 is provided inside the sleeve 1.

A conventional electron-emissive layer 3 is made from a powder of a composite alkaline earth metal carbonate . which contains elements of Ba, Sr and Ca. A suspension which contains the powder and a binder is applied to the base 2 by a spray method or the like. The applied suspension is heated in a dynamic vacuum and then aged at a higher temperature.

In order to prepare the suspension which has a viscosity suitable for, e.g., a spray application and has a uniform adhesiveness to the base 2, the powder is usually mixed with the binder and a solvent in a ball mill for about 24 hours. Typically, an organic solvent such as butyl acetate or alcohol is used as the solvent, and nitrocellulose dissolved in an organic solvent such as butyl acetate may be used as the binder.

The alkaline earth metal carbonate layer applied to the base 2 is heated by the heater 4 in a dynamic vacuum thereby to convert it into a ternary composite oxide layer of (Ba, Sr, Ca)O. This conversion can be expressed by the following reaction formula (1), and the generated $CO_2$ gas is evacuated by a vacuum pump.

$$(Ba, Sr, Ca)CO_3 \rightarrow (Ba, Sr, Ca)O + CO_2 \quad (1)$$

After the conversion, the composite oxide layer on the base 2 is aged at a higher temperature of 900°–1100° C. so that the ternary composite oxide of (Ba, Sr, Ca)O may be reduced to produce at least some of free Ba by a reducing element such as Si or Mg contained in the base 2 thereby to form the electron-emissive layer 3. Such a reducing element in the base 2 diffuses toward the interface between the composite oxide layer and the base 2, and then reacts with the composite oxide. For example, the reduction of BaO is expressed by the following formula (2a) or (2b).

$$2BaO + Si = 2Ba + SiO_2 \quad (2a)$$

$$BaO + Mg = Ba + MgO \quad (2a)$$

When part of BaO in the composite oxide layer is reduced to free Ba, the layer becomes a semiconductor of an oxygen deficient type. Consequently, the layer 3 of the electron-emissive substance is obtained and it can be used at a current density of 0.5–0.8A/cm$^2$ at an operating temperature of 700°–800° C.

With the conventional cathode, an emission current density higher than the above described one can not be obtained for the following reasons ① and ② . ① As a result of the reaction during the aging, an intermediate layer of an oxide such as $SiO_2$ or MgO is formed between the base 2 and the electron-emissive layer 3, so that the current is limited by a high resistance of the intermediate layer. ② The reduction of the alkaline earth metal oxide is limited by intermediate layer and thus an enough amount of free Be is not produced.

As described above, the conventional cathode can not be used at a high current density. Further, there exists a problem that since the conventional electron-emissive layer 3 is of a semiconductor, the layer 3 may be destroyed thermally due to the Joule heat at a high current density.

SUMMARY OF THE INVENTION

It is an object of this invention to provide a cathode for an electron tube having improved electron emission characteristics.

It is another object of this invention to provide a long-lived cathode for an electron tube.

It is a further object of this invention to provide a cathode for an electron tube having stable electron emission characteristics.

It is a still further object of this invention to provide a method for manufacturing the above improved cathode.

A cathode for an electron tube in accordance with the present invention comprises: a base containing not only nickel as a major element but also a reducing agent; a layer of an electron-emissive substance which is applied to the base and contains not only an alkaline earth metal oxide as a principal component but also a scandium oxide; and a heater for heating the layer.

A method for manufacturing a cathode for an electron tube in accordance with the present invention comprises steps of: subjecting a scandium oxide powder to a heat treatment; preparing a suspension which contains the heat-treated scandium oxide powder and an alkaline earth metal carbonate powder; and applying said suspension to a base in order to form an electron-emissive layer.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Embodiments in accordance with this invention will be described below.

A scandium oxide powder was first subjected to a heat treatment at 1000° C. for 1 hr in the air. In the meantime, a suspension which contains an alkaline earth metal carbonate has been prepared in advance. Then, the scandium oxide powder was mixed and well dispersed in the suspension by a ball mill. Finally, suspensions which contain the scandium oxide powder in the ratio of 0.1, 1.0, 5.0, 10 and 20 wt. % with respect to the alkaline earth metal carbonate powder were prepared. Those suspensions were applied to the respective bases 2. When the bases are 2 mm in diameter, it is preferable that be 60–100 μm in thickness. Cathodes thus prepared were then incorporated into respective electron guns (not shown). Those cathodes were heated under a dynamic vacuum and aged by a convential method thereby to complete respective cathode-ray tubes.

Figure 1:
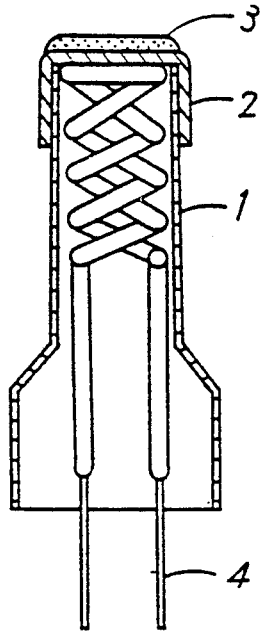
FIG. 1 illustrates the structure of a cathode for an electron tube in a sectional view.
Figure 2:
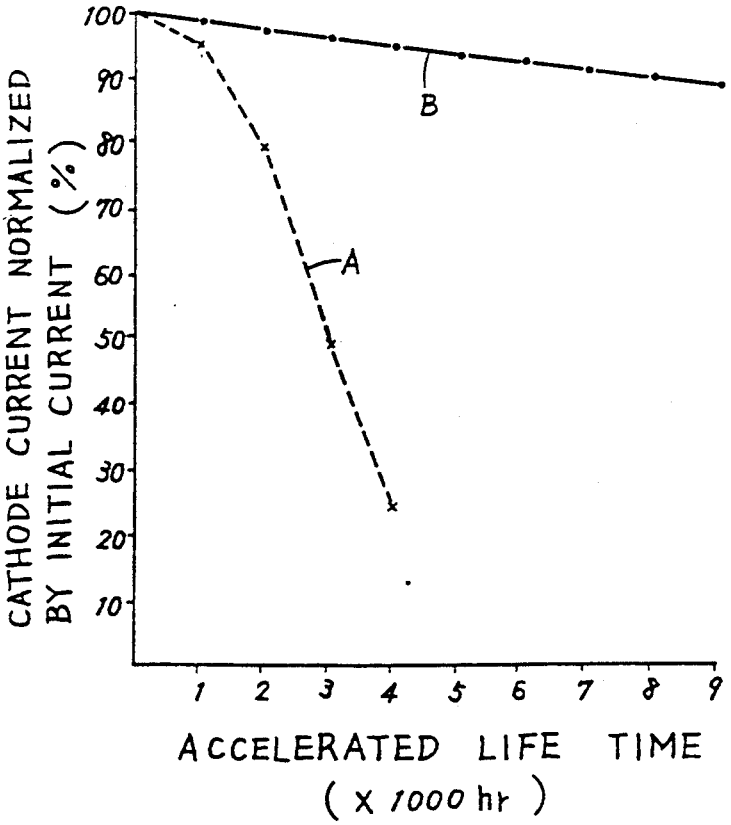
FIG. 2 shows results of accelerated life tests of a conventional cathode and a cathode according to the present invention.

Referring to FIG. 2, there are shown results of accelerated life tests of a conventional cathode and one of the present cathodes with an initial current density of $2A/cm^2$. The current density of $2A/cm^2$ is three times larger than the usual density. The vertical axis indicates the cathode current normalized by the initial one, while the horizontal axis indicates the life test period. A broken line A represents the conventional cathode, while a solid line B represents a cathode which has an electron-emissive layer containing the scandium oxide in 5.0 wt. %. It is clearly understood from the lines A and B that the present cathode has a much longer life period and is much more stable in comparison with the conventional cathode. Namely, it is found that the present cathode can be used substantially maintaining the high current density of $2A/cm^2$ at the operation temperature of 700°–800° C.

It is believed that the good electron emission characteristics of the present cathode is caused by the following reasons (1) and (2).

(1) The scandium oxide reacts with the alkaline earth metal oxide, e.g., BaO and forms a composite oxide of $Ba_3Sc_4O_9$. This composite oxide dispersed in the electron-emissive layer 3 tends to thermally decompose and produce free Ba at the operation temperature of the cathode. Although the formation of free Ba in the conventional cathode completely depends on the reducing process caused by the element Si or Mg in the base 2, the thermal decomposition of the composite oxide produces additional free Ba in the present cathode. Therefore, there exists enough free Ba in the present cathode, even though the reducing process is limited by the intermediate layer described before.

(2) Some of the composite oxide also set the Sc element free and produce metallic Sc dispersed in the electron-emissive layer 3. This metallic Sc increases electric conductivity of the electron-emissive layer 3, compensating for the resistance of the intermediate layer.

Figure 3A:
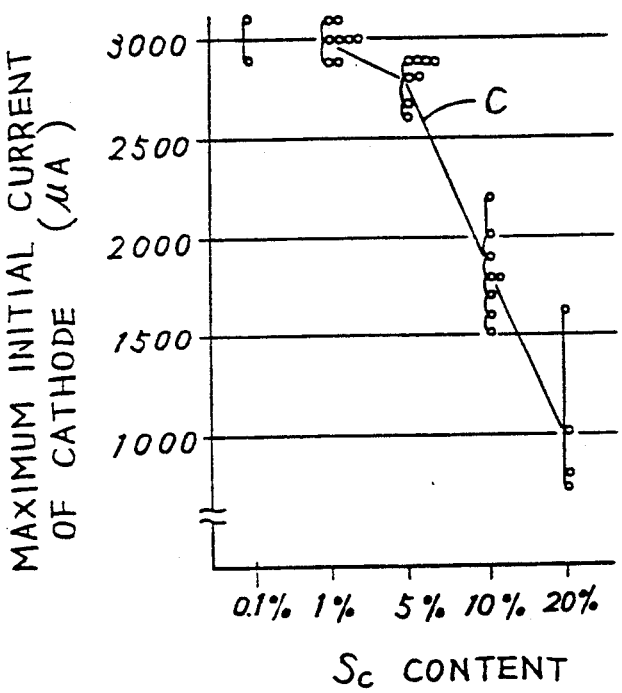
FIGS. 3A and 3B reveal an effect of the heat . treatment for the scandium oxide powder in the present invention.
Figure 3B:
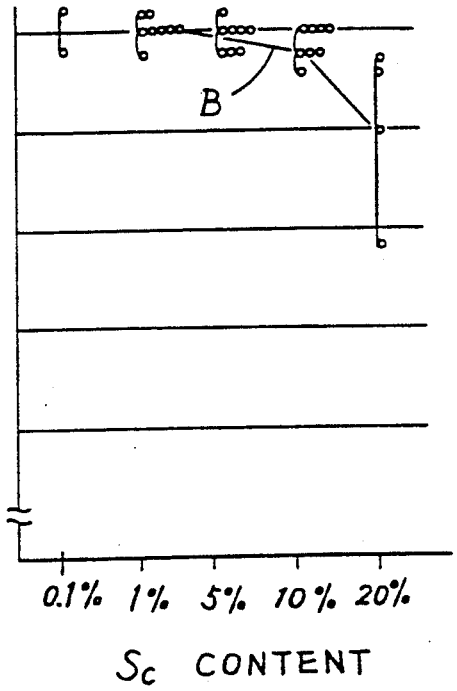

Comparing FIGS. 3A and 3B, there will be seen a preferable effect of the above described heat treatment for the scandium oxide powder. In each of the figures, the vertical axis indicates the maximum initial cathode current, while the horizontal axis indicates the scandium oxide content. The scandium oxide powder was not subjected to the heat treatment in FIG. 3A, though it was subjected to in FIG. 3B. As seen from a plotted curve C in FIG. 3A, the maximum initial cathode current decreases steeply as increase of the non-treated scandium oxide content, and also scattering of the current values with the same scandium oxide content is large. As seen from a plotted curve B in FIG. 3B, on the other hand, the initial cathode current decreases much more gently as increase of the treated scandium oxide content, and further scattering of the current values with the same scandium oxide content is not so large. Namely, the heat treatment for the scandium oxide powder ensures the stable current characteristics of the cathode regardless of the scandium oxide content.

Figure 4:
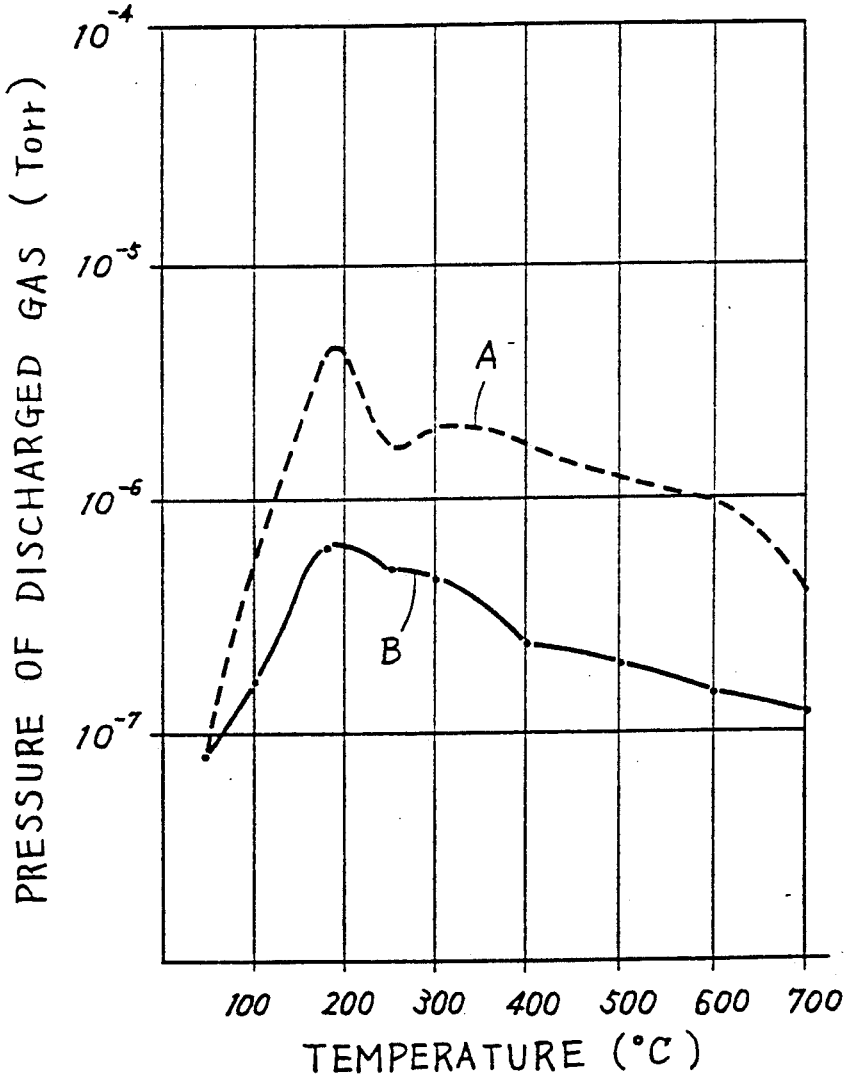
FIG. 4 shows gas discharge from the heat-treated and non-treated scandium powders.

Referring to FIG. 4, the reason for the above described effect of the heat treatment will be understood. The vertical axis indicates the pressure of gas discharged from the scandium oxide powder, while the horizontal axis indicates the temperature. A solid line B and a broken line C represent the gas discharge characteristics of the heat-treated and non-treated scandium oxide powders, respectively. Since the non-treated scandium oxide powder discharges more gas containing oxygen, the oxygen gas discharged during the above described aging process again oxidizes and decreases the free Ba. Namely, the less gas discharge of the heat-treated scandium oxide powder ensures the stable current characteristics of the cathode.

Figure 5:
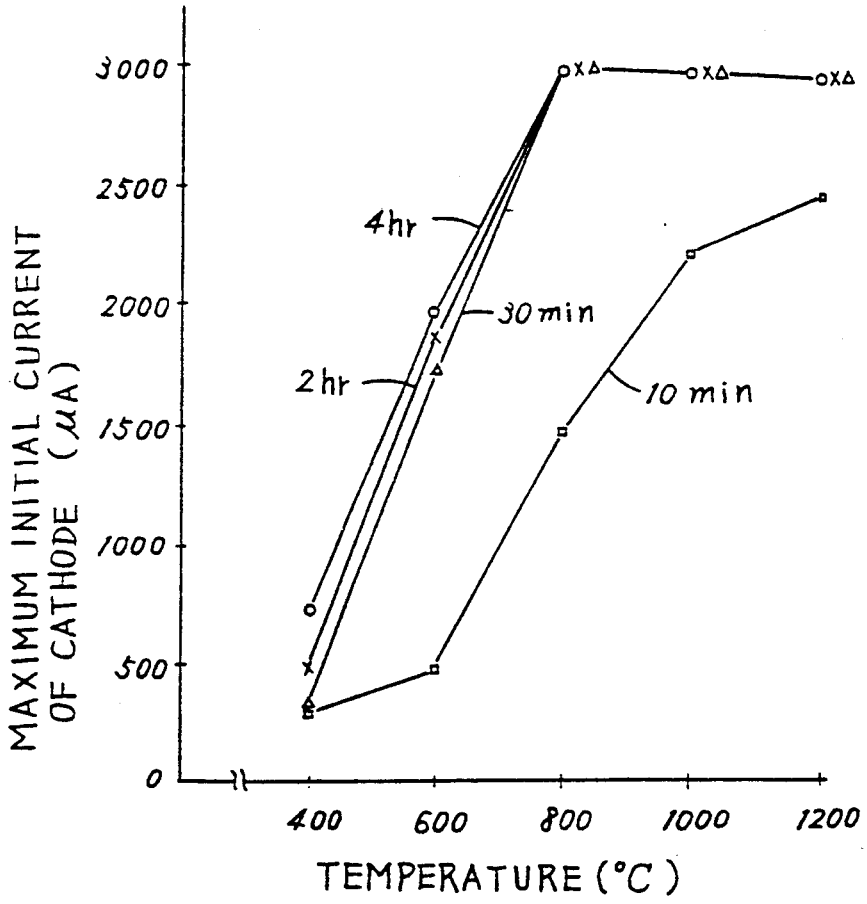
FIG. 5 shows the influence of the temperature and time of the heat treatment.

Referring to FIG. 5, there is shown the influence of the temperature and time of the heat treatment on the maximum initial current of the cathode. The vertical axis indicates the cathode current, while the horizontal axis indicates the temperature. As seen in FIG. 5, the heat treatment at a temperature more than 800° C. for a period more than 30 min shows the preferable effect on the cathode current. However, the period more than 2 hr does not produce any additional or better effect. Meanwhile, the temperature higher than 1100° C. tends to make the scandium oxide powder sintered, and the scandium oxide powder thus heat-treated is not so well dispersed in the suspension. Consequently, the heat treatment at 800°–1100° C. for 0.5–2 hr in an oxidizing atmosphere containing oxygen gas may be preferable.

The cathodes with the scandium oxide contents of 0.1, 1.0, 5.0, 10 and 20 wt. % have been described, because the scandium oxide content of less than 0.1 wt. % shows little effect in the accelerated life test and the same of more than 20 wt. % largely deteriorates the maximum initial current characteristics of the cathode.

Although the scandium oxide powder was added and mixed in the suspension which had been prepared in advance and contained the alkaline earth metal carbonate in the above embodiments, the scandium oxide powder may be simultaneously mixed with the alkaline earth metal carbonate, the binder and the organic solvent by a ball mill.

The present invention is applicable to cathodes for a cathode-ray tube, a pickup tube, a transmitting tube, a discharge tube, etc.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method for manufacturing a cathode for an electron tube, comprising steps of:

subjecting a scandium oxide powder to a heat treatment at a temperature of 800°-1100° C. for more than 30 minutes in an oxiding atmosphere, preparing a suspension which contains said heat-treated scandium oxide powder, an alkaline earth metal carbonate powder, a binder and an organic solvent applying said suspension to a base comprising nickel as a major element and a reducing agent in order to form an electron-emissive layer on said base and then heating said base.

2. The method in accordance with claim 1, wherein said scandium oxide powder is mixed in the ratio of 0.1-20 wt. % with respect to said alkaline earth metal carbonate powder.

3. The method in accordance with claim 1, wherein said binder is of nitrocellulose dissolved in butyl acetate.

4. The method in accordance with claim 1, wherein said organic solvent comprises at least one of butyl acetate and alcohol.

5. The method in accordance with claim 1, wherein said reducing agent comprises at least one of silicon and magnesium.

6. The method in accordance with claim 1 wherein said alkaline earth metal carbonate powder comprises carbonates of barium, strontium and calcium.

* * * * *